US011535488B2

(12) United States Patent
Ginsberg et al.

(10) Patent No.: US 11,535,488 B2
(45) Date of Patent: Dec. 27, 2022

(54) ELEVATOR POSITION DETECTION SYSTEMS

(71) Applicant: Otis Elevator Company, Farmington, CT (US)

(72) Inventors: David Ginsberg, Granby, CT (US); Ronnie E. Thebeau, Haddam, CT (US); David Alun James, Cambridge (GB)

(73) Assignee: OTIS ELEVATOR COMPANY, Farmington, CT (US)

( * ) Notice: Subject to any disclaimer, the term of this patent is extended or adjusted under 35 U.S.C. 154(b) by 1117 days.

(21) Appl. No.: 15/975,845

(22) Filed: May 10, 2018

(65) Prior Publication Data

US 2019/0062106 A1 Feb. 28, 2019

Related U.S. Application Data

(60) Provisional application No. 62/550,891, filed on Aug. 28, 2017.

(51) Int. Cl.

| | |
|---|---|
| ***B66B 1/40*** | (2006.01) |
| ***B66B 3/02*** | (2006.01) |
| ***B66B 1/34*** | (2006.01) |

(52) U.S. Cl.

CPC ..... *B66B 1/40* (2013.01); *B66B 1/3492* (2013.01); *B66B 3/02* (2013.01)

(58) Field of Classification Search

CPC ..... B66B 1/40; B66B 1/3492; B66B 3/02

See application file for complete search history.

(56) References Cited

U.S. PATENT DOCUMENTS 4,218,671 A 8/1980 Lewis
5,798,490 A * 8/1998 Vairio ..... B66B 1/3492 187/394

(Continued)

FOREIGN PATENT DOCUMENTS

CN 101597001 12/2009
CN 202296658 U 7/2012

(Continued)

OTHER PUBLICATIONS

European Office Action, European Application No. 18190852.6, dated Oct. 8, 2020, European Patent Office; EP Search Report 4 pages.

(Continued)

*Primary Examiner* — Christopher Uhlir
(74) *Attorney, Agent, or Firm* — Cantor Colburn LLP

(57) ABSTRACT

Elevator systems having an elevator machine connected to an elevator car within an elevator shaft, the elevator shaft including a plurality of landings, at least one first sensor assembly attached to the elevator car, at least one second sensor assembly arranged within the elevator shaft and configured to interact with the at least one first sensor assembly, and a computing system in communication with at least one of the at least one first sensor assemblies and the at least one second sensor assemblies such that the computing system receives at least one of signals or data from the at least one of the at least one first sensor assemblies and the at least one second sensor assemblies. The at least one first sensor assemblies and the at least one second sensor assemblies form a contactless position sensing system for determining a position of the elevator car within the elevator shaft.

15 Claims, 8 Drawing Sheets

(56) References Cited

U.S. PATENT DOCUMENTS

| | | | | |
|---|---|---|---|---|
| 5,815,091 | A | 9/1998 | Dames et al. | |
| 6,026,935 | A | 2/2000 | Koh | |
| 6,952,086 | B1 | 10/2005 | Krefta et al. | |
| 7,546,903 | B2 * | 6/2009 | Kattainen | B66B 1/3492 187/316 |
| 8,276,716 | B2 * | 10/2012 | Meri | B66B 1/3492 187/394 |
| 9,567,188 | B2 | 2/2017 | Huff et al. | |
| 2007/0227831 | A1 | 10/2007 | Zaharia | |
| 2010/0001718 | A1 * | 1/2010 | Howard | G01B 7/30 324/207.15 |
| 2014/0299422 | A1 | 10/2014 | Kangas et al. | |
| 2015/0217968 | A1 * | 8/2015 | Huff | B66B 5/0025 187/394 |
| 2015/0336768 | A1 | 11/2015 | Otsuka et al. | |
| 2016/0039635 | A1 | 2/2016 | Kangas et al. | |
| 2016/0311649 | A1 | 10/2016 | Puranen et al. | |

FOREIGN PATENT DOCUMENTS

| | | | |
|---|---|---|---|
| CN | 202924504 | U | 5/2013 |
| CN | 205575305 | U | 9/2016 |
| EP | 3378820 | A1 | 9/2018 |
| JP | 3336639 | B2 | 10/2002 |
| JP | 2007008638 | A | 1/2007 |
| WO | 2004013030 | A1 | 2/2004 |
| WO | 2004028946 | A1 | 4/2004 |
| WO | 2004033352 | A1 | 4/2004 |
| WO | 2005035418 | A1 | 4/2005 |
| WO | 2006080633 | A1 | 8/2006 |
| WO | 2013118317 | A1 | 8/2013 |
| WO | 2015059821 | A1 | 4/2015 |

OTHER PUBLICATIONS

European Search Report, European Application No. 18190852.6, dated Jan. 7, 2019, European Patent Office; EP Search Report 9 pages.

European Office Action, European Application No. 18190852.6, dated Nov. 12, 2021, European Patent Office; 5 pages.

* cited by examiner

ELEVATOR POSITION DETECTION SYSTEMS

CROSS-REFERENCE TO RELATED APPLICATIONS

The present application claims priority from U.S. Provisional Patent Application No. 62/550,891, filed Aug. 28, 2017. The content of the priority application is hereby incorporated by reference in its entirety.

BACKGROUND

The subject matter disclosed herein generally relates to elevator systems and, more particularly, to elevator position detection systems.

An elevator system typically includes a plurality of belts or ropes (load bearing members) that move an elevator car vertically within a hoistway or elevator shaft between a plurality of elevator landings. Determination of the position of the elevator car within the elevator shaft can be used for various elevator operations and/or functions. For example, elevator car positioning and leveling at a landing during loading/unloading of the elevator car can be based on active detection of the precise position of the elevator car within the elevator shaft. Accordingly, precise and accurate elevator position sensors and/or systems are advantageous.

BRIEF SUMMARY

According to some embodiments, elevator systems are provided. The elevator systems include an elevator machine operably connected to an elevator car located within an elevator shaft, the elevator shaft including a plurality of landings, at least one first sensor assembly attached to the elevator car, at least one second sensor assembly arranged within the elevator shaft and configured to interact with the at least one first sensor assembly, and a computing system in communication with at least one of the at least one first sensor assemblies and the at least one second sensor assemblies such that the computing system receives at least one of signals or data from the at least one of the at least one first sensor assemblies and the at least one second sensor assemblies. The at least one first sensor assemblies and the at least one second sensor assemblies form a contactless position sensing system for determining a position of the elevator car within the elevator shaft.

In addition to one or more of the features described herein, or as an alternative, further embodiments of the elevator systems may include that the at least one first sensor assembly comprises a transmit coil and two receive coils.

In addition to one or more of the features described herein, or as an alternative, further embodiments of the elevator systems may include that the two receive coils comprise a sine coil and a cosine coil.

In addition to one or more of the features described herein, or as an alternative, further embodiments of the elevator systems may include that the second sensor assembly comprises a passive cooperating tag.

In addition to one or more of the features described herein, or as an alternative, further embodiments of the elevator systems may include that the at least one second sensor assembly comprises a plurality of second sensor assemblies, wherein each landing of the elevator shaft includes an associated second sensor assembly of the plurality of sensor assemblies.

In addition to one or more of the features described herein, or as an alternative, further embodiments of the elevator systems may include that the at least one second sensor assembly comprises a first tag and a second tag, wherein the first and second tags are independently interactive with the at least one first sensor assembly.

In addition to one or more of the features described herein, or as an alternative, further embodiments of the elevator systems may include that the at least one second sensor assembly comprises at least one tag having a predetermined frequency set to identify a specific landing.

In addition to one or more of the features described herein, or as an alternative, further embodiments of the elevator systems may include that the at least one first sensor comprises a plurality of sensors and the at least one second sensor assembly comprises a plurality of tags, wherein the at least one sensor and at least one tag define a sensor pair.

In addition to one or more of the features described herein, or as an alternative, further embodiments of the elevator systems may include that a unique position offset among the at least one tag in the at least one second sensor assembly within the elevator shaft is measureable to determine a landing within the elevator shaft.

In addition to one or more of the features described herein, or as an alternative, further embodiments of the elevator systems may include that the plurality of sensors and the plurality of tags define overlapping detection regions.

In addition to one or more of the features described herein, or as an alternative, further embodiments of the elevator systems may include that the at least one first sensor assembly is mounted to a toe guard of the elevator car.

In addition to one or more of the features described herein, or as an alternative, further embodiments of the elevator systems may include an elevator controller, wherein the computing system is in communication with the elevator controller, the elevator controller arranged to control operation of the elevator car within the elevator shaft.

In addition to one or more of the features described herein, or as an alternative, further embodiments of the elevator systems may include that the computing system is an integral component of the elevator controller.

In addition to one or more of the features described herein, or as an alternative, further embodiments of the elevator systems may include that at least one of the computing system and the elevator controller are arranged to detect a location of the elevator car within the elevator shaft based on a detection of a plurality of tags of the at least one second sensor assembly in at least one of a unique position and unique frequency configuration.

In addition to one or more of the features described herein, or as an alternative, further embodiments of the elevator systems may include that at least one of the computing system and the elevator controller control the position of the elevator car based on the determined position of the elevator car.

In addition to one or more of the features described herein, or as an alternative, further embodiments of the elevator systems may include that at least one of the computing system and the elevator controller control a leveling operation of the elevator car relative to a landing based on the determined position of the elevator car.

According to some embodiments, methods for installing elevator cars within an elevator shaft having a plurality of landings are provided. The methods include installing at least one first sensor assembly on the elevator car, installing a plurality of second sensor assemblies within the elevator shaft, wherein at least one second sensor assembly is installed at each landing of the plurality of landings, wherein the at least one first sensor assemblies and the at least one second sensor assemblies form a contactless position sensing system for determining a position of the elevator car within the elevator shaft, moving the elevator car to each landing of the plurality of landings and identifying which second sensor assembly of the plurality of second sensor assemblies is associated with each landing, measuring a landing error at each landing, providing the landing error for each landing to a computing system, and adjusting during elevator operation, with an elevator machine, a landing position of the elevator car.

In addition to one or more of the features described herein, or as an alternative, further embodiments of the methods may include that the at least one first sensor assembly comprises transmit and receive coils and each second sensor assembly comprises a passive cooperating tag.

In addition to one or more of the features described herein, or as an alternative, further embodiments of the methods may include that the second sensor assemblies each comprise a first tag and a second tag, wherein the first and second tags are independently interactive with the at least one first sensor assembly.

In addition to one or more of the features described herein, or as an alternative, further embodiments of the methods may include that each second sensor assembly comprises at least one tag, further comprising identifying a specific landing based on at least one of the tag of each landing having a predetermined frequency set to identify the specific landing and a the unique position offset among the tags in the at least one second sensor assembly.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
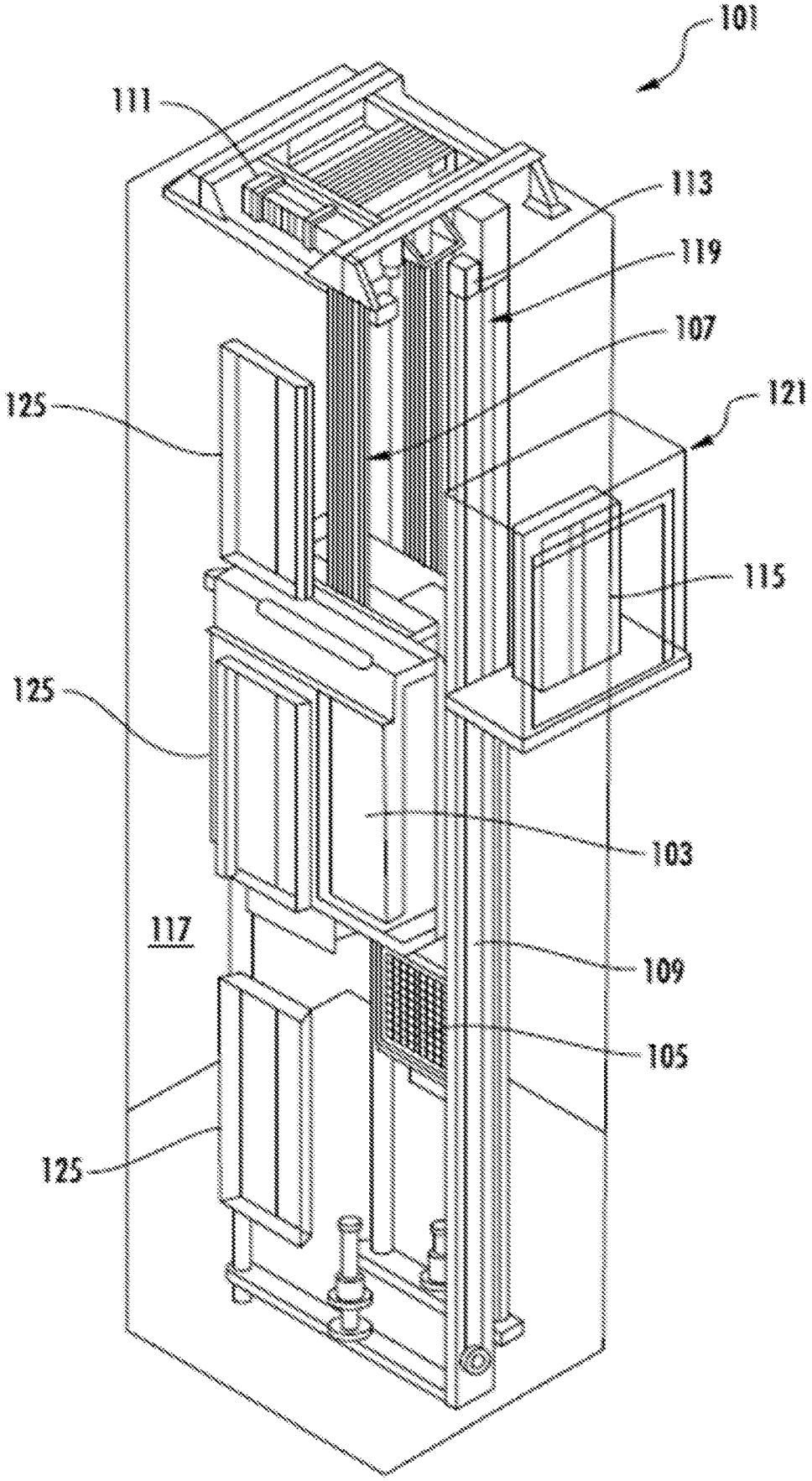
FIG. 1 is a schematic illustration of an elevator system that may employ various embodiments of the present disclosure.

FIG. 1 is a perspective view of an elevator system 101 including an elevator car 103, a counterweight 105, one or more load bearing members 107, a guide rail 109, a machine 111, a motion state sensor 113, and an elevator controller 115. As used herein, the term "motion state" includes, but is not limited to, position, velocity, and acceleration. That is, the motion state of the elevator car can be the absolute position of the car within an elevator shaft, the first derivation or change in position of the position of the car (e.g., velocity), or the second derivative or change in velocity of the car (e.g., acceleration). Accordingly, motion state is not limited to merely motion, but also includes a static or absolute position of the elevator car and movement of the car within the elevator shaft. The motion state sensor 113 can be an encoder, an optical sensor, or other type of sensor and/or sensor assembly as will be appreciated by those of skill in the art.

The elevator car 103 and counterweight 105 are connected to each other by the load bearing members 107. The load bearing members 107 may be, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The load bearing members 107 engage the machine 111, which is part of an overhead structure of the elevator system 101. The machine 111 is configured to control movement between the elevator car 103 and the counterweight 105. The motion state sensor 113 may be mounted on an upper sheave of a speed-governor system 119 and may be configured to provide motion state signals related to a motion state of the elevator car 103 within the elevator shaft 117. In other embodiments, the motion state sensor 113 may be directly mounted to a moving component of the machine 111, or may be located in other positions and/or configurations as known in the art.

The elevator controller 115 is located, as shown, in a controller room 121 of the elevator shaft 117 and is configured to control the operation of the elevator system 101, and particularly the elevator car 103. For example, the elevator controller 115 may provide drive signals to the machine 111 to control the acceleration, deceleration, leveling, stopping, etc. of the elevator car 103. The elevator controller 115 may also be configured to receive motion state signals from the motion state sensor 113. When moving up or down within the elevator shaft 117 along guide rail 109, the elevator car 103 may stop at one or more landings 125 as controlled by the elevator controller 115. Although shown in a controller room 121, those of skill in the art will appreciate that the elevator controller 115 can be located and/or configured in other locations or positions within the elevator system 101. In some embodiments, the elevator controller 115 can be configured to control features within the elevator car 103, including, but not limited to, lighting, display screens, music, spoken audio words, etc.

The machine 111 may include a motor or similar driving mechanism and an optional braking system. In accordance with embodiments of the disclosure, the machine 111 is configured to include an electrically driven motor. The power supply for the motor may be any power source, including a power grid, which, in combination with other components, is supplied to the motor. Although shown and described with a rope-based load bearing system, elevator systems that employ other methods and mechanisms of moving an elevator car within an elevator shaft, such as hydraulics or any other methods, may employ embodiments of the present disclosure. FIG. 1 is merely a non-limiting example presented for illustrative and explanatory purposes.

In elevator systems, such as that shown in FIG. 1, landing position sensors, or vanes, are typically needed to detect a position of the elevator car relative to a landing. That is, such position detection systems are used to determine if an elevator car is appropriately positioned relative to a landing to enable loading/unloading of the elevator car, or whether the elevator car is slightly above or below the landing (i.e., a position offset). Current systems typically use discrete sensors to divide the positions near the landing into multiple zones which indicate the position of the elevator car relative to the landing. Direct sensing of small changes of the car position within these zones is not currently possible with these discrete sensors.

Embodiments provided herein are directed to contactless linear position sensors and systems associated therewith for accurately determine the position of an elevator car within an elevator shaft. In accordance with some embodiments, the contactless linear position sensors are based on resonant inductive PCB coils. In one non-limiting example, a 'long' sensor with a transmit coil, and two receive coils (sine and cosine), are attached to the elevator car while passive cooperating tags (e.g., reflecting coils, resonant elements, etc.) are fixed at various locations within the elevator shaft, such as at one or more of the landings. In operation, variations in position correspond to ratios, differences, or other relationships in the received signal on the sine and cosine coils. An assembly of sensors and tags of a similar arrangement can be employed to provide redundancy for safety critical operations, provide extended stroke allowing the sensor(s) to operate outside the redundant range, and enable unique identification of landings, floors, etc. within the elevator shaft.

In some embodiments, the ratio of the signals is employed, (e.g., the position is encoded as the [signed] arctan). In such embodiments, use of the ratio compensates for separation that reduces both sine and cosine signal proportionally.

In some embodiments, resonant tags may be employed for the tags. The resonant tags are responsive to a transmitted electromagnetic signal from the sensor. In response to the transmitted electromagnetic signal, the resonant tags will energize and re-radiate a signal that is detectable by the signal.

Accordingly, although various specific sensor-tag arrangements are described herein, the specific embodiments are not to be limiting. That is, any particular arrangement of sensor-tag configuration may be employed without departing from the scope of the present disclosure. As referred to herein, co-operating tags may be responsive to inductively coupled coils (or other types of coils/sensors/signal generators), to form the sensor-tag arrangement, with the specific technical, physical, electrical, magnetic, or other property of the signal/detection based on the specific application desired.

Figure 2:
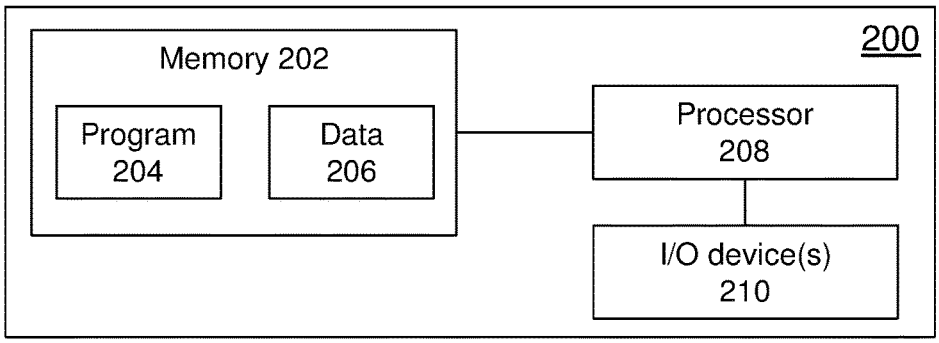
FIG. 2 is a schematic block diagram illustrating a computing system that may be configured for one or more embodiments of the present disclosure.

Referring now to FIG. 2, an example computing system 200 that can be incorporated into elevator positioning systems of the present disclosure is shown. The computing system 200 may be configured as part of and/or in communication with an elevator controller, e.g., controller 115 shown in FIG. 1, and/or as part of an elevator positioning system as described herein. The computing system 200 includes a memory 202 which can store executable instructions and/or data associated with elevator positioning system, such as stored tag memory, floor information, elevator car information, etc. The executable instructions can be stored or organized in any manner and at any level of abstraction, such as in connection with one or more applications, processes, routines, procedures, methods, etc. As an example, at least a portion of the instructions are shown in FIG. 2 as being associated with an elevator positioning program 204.

As noted, the memory 202 may store data 206. The data 206 may include, but is not limited to, elevator car data, elevator modes of operation, commands, or any other type(s) of data as will be appreciated by those of skill in the art. The instructions stored in the memory 202 may be executed by one or more processors, such as a processor 208. The processor 208 may be operative on the data 206.

The processor 208, as shown, is coupled to one or more input/output (I/O) devices 210. In some embodiments, the I/O device(s) 210 include external devices such as sensors, monitoring elements, etc. For example, external sensors can collect data and provide input into the processor 208 for processing (e.g., analyzing, storing, transmitting, etc.), and thus the processor 208 can receive signals from the sensors (i.e., be in communication therewith). The components of the computing system 200 may be operably and/or communicably connected by one or more buses. The computing system 200 may further include other features or components as known in the art. For example, the computing system 200 may include one or more transceivers and/or devices configured to transmit and/or receive information or data from sources external to the computing system 200 (e.g., part of the I/O devices 210). For example, in some embodiments, the computing system 200 may be configured to receive information over a network (wired or wireless) or through a cable or wireless connection with one or more devices remote from the computing system 200 (e.g. direct connection to the elevator controller 115, etc.). The information received over the communication network can stored in the memory 202 (e.g., as data 206) and/or may be processed and/or employed by one or more programs or applications (e.g., program 204) and/or the processor 208.

The computing system 200 is one example of a computing system, controller, and/or control system that is used to execute and/or perform embodiments and/or processes described herein. For example, the computing system 200, when configured as part of an elevator control system, is used to receive information from one or more sensors and can be configured to control operation of an elevator car through control of an elevator machine. For example, the computing system 200 can be integrated into or separate from (but in communication therewith) an elevator controller and/or elevator machine and operate as a portion of an elevator positioning system. The computing system 200 is configured to operate and/or control elevator car positioning within an elevator shaft, such as relative to one or more landings of the elevator shaft.

Figure 3:
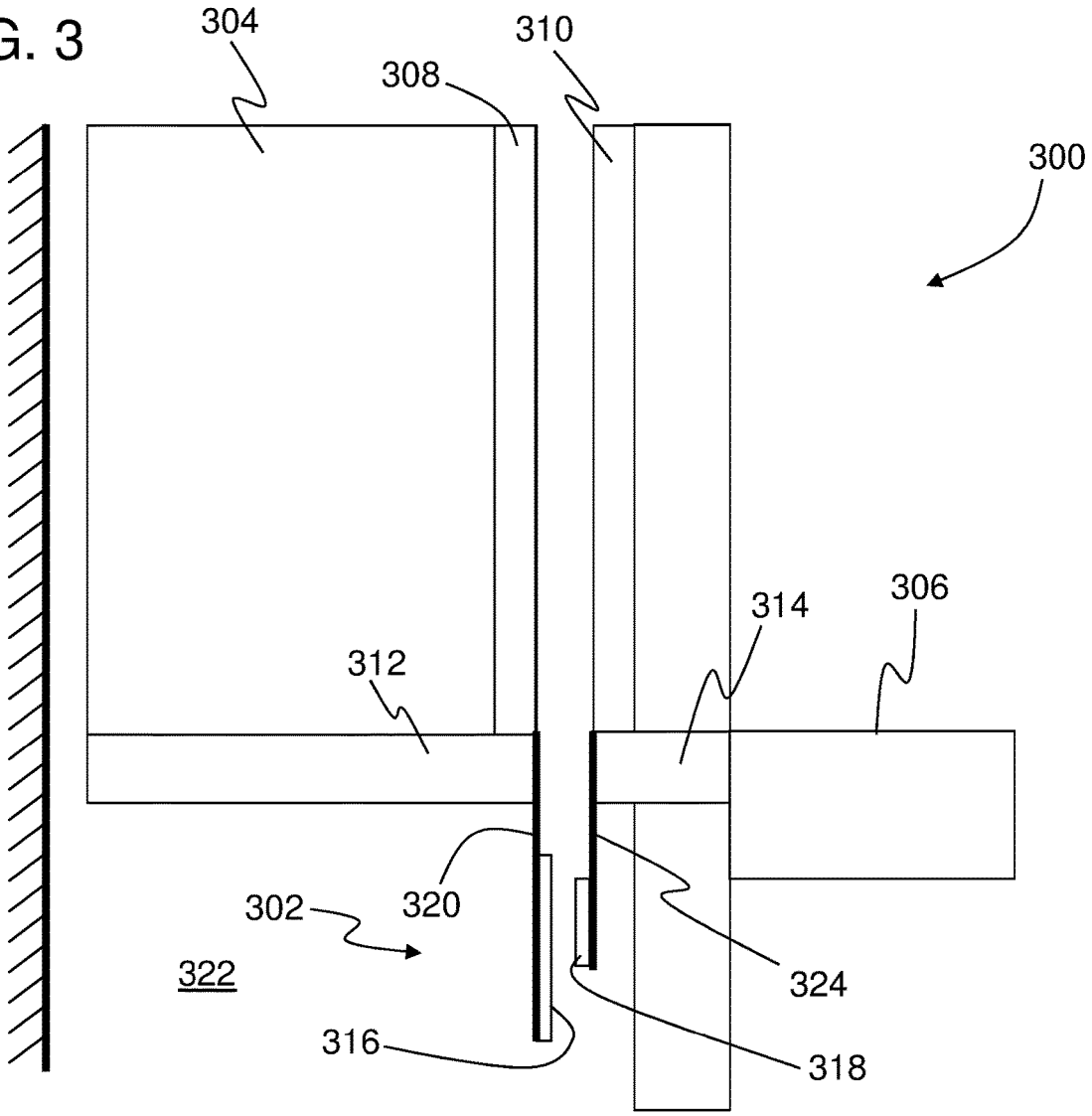
FIG. 3 is a schematic diagram of an elevator system having an elevator positioning system in accordance with an embodiment of the present disclosure.

Turning now to FIG. 3, a schematic illustration of an elevator system 300 incorporating an elevator positioning system 302 in accordance with an embodiment of the present disclosure is shown. The illustration of FIG. 3 is a side view illustration of an elevator car 304 located at a landing 306. Passengers can enter and/or exit the elevator car 304 when an elevator car door 308 is aligned with a landing door 310. Proper alignment of the elevator car 304 with the landing 306 is desirable to prevent an offset such that a passenger may trip over a car sill 312 or a landing sill 314.

To ensure precise positioning of the elevator car 304 relative to the landing 306, the elevator system 300 includes the elevator positioning system 302. The elevator positioning system 302 includes at least one first sensor assembly 316 and at least one second sensor assembly 318. As illustrated, the first sensor assembly 316 is attached to or part of the elevator car 304. Specifically, in this embodiment, the first sensor assembly 316 is mounted to a car toe guard 320. The first sensor assembly 316 is movable with the elevator car 304. The second sensor assembly 318 is fixed within an elevator shaft 322, and in this embodiment, the second sensor assembly 318 is fixed to a landing fascia 324.

The first and second sensor assemblies 316, 318 are, in some embodiments, contactless linear position sensors. In one non-limiting embodiment, the first and second sensors assemblies 316, 318 are resonant inductive PCB coils. In some embodiments, the first sensor assembly 316 (mounted to the elevator car 304) is a 'long' sensor with transmit and sense coils. For example, in one non-limiting example, a transmit coil and two receive coils (e.g., sine and cosine) can be provided. In some such examples, some coils can be formed in sine and/or cosine patterns which can correspond to directions of motion. The second sensor assembly 318 is a passive cooperating tag that is fixed at the landing 306. In embodiments employing sine and cosine coils, variations in position of the elevator car 304 relative to the landing 306 correspond to differences in the signal between the sine and cosine coils of the first sensor assembly 316 with the second sensor assembly 318. In some embodiments, an assembly of sensors and tags is employed to enable redundancy for safety critical operations, to extend stroke allowing the sensors to operate outside of the redundant range, and to uniquely identify floors or landings along the elevator shaft 322.

In accordance with non-limiting embodiments of the present disclosure, the sensor assemblies 316, 318 can be formed from one or more sensor elements. As noted, in one example, the first sensor assembly 316 can include an active transmit sensor element and one or more passive receive sensor elements. In such system the second sensor assembly 318 can include one or more passive elements that are interactive with the first sensor assembly 316 when the first sensor assembly 316 is located in proximity to the elements of the second sensor assembly 318.

In operation, as the elevator car 304 moves within the elevator shaft 322 relative to the landing 306, the first sensor assembly 316 moves relative to the second sensor assembly 318. The sensor assemblies 316, 318 enable position signals to be calculated by combinations of sensor elements interacting with each other, thus providing redundancy (where needed), extended sensor stroke, and landing identification.

Figure 4A:
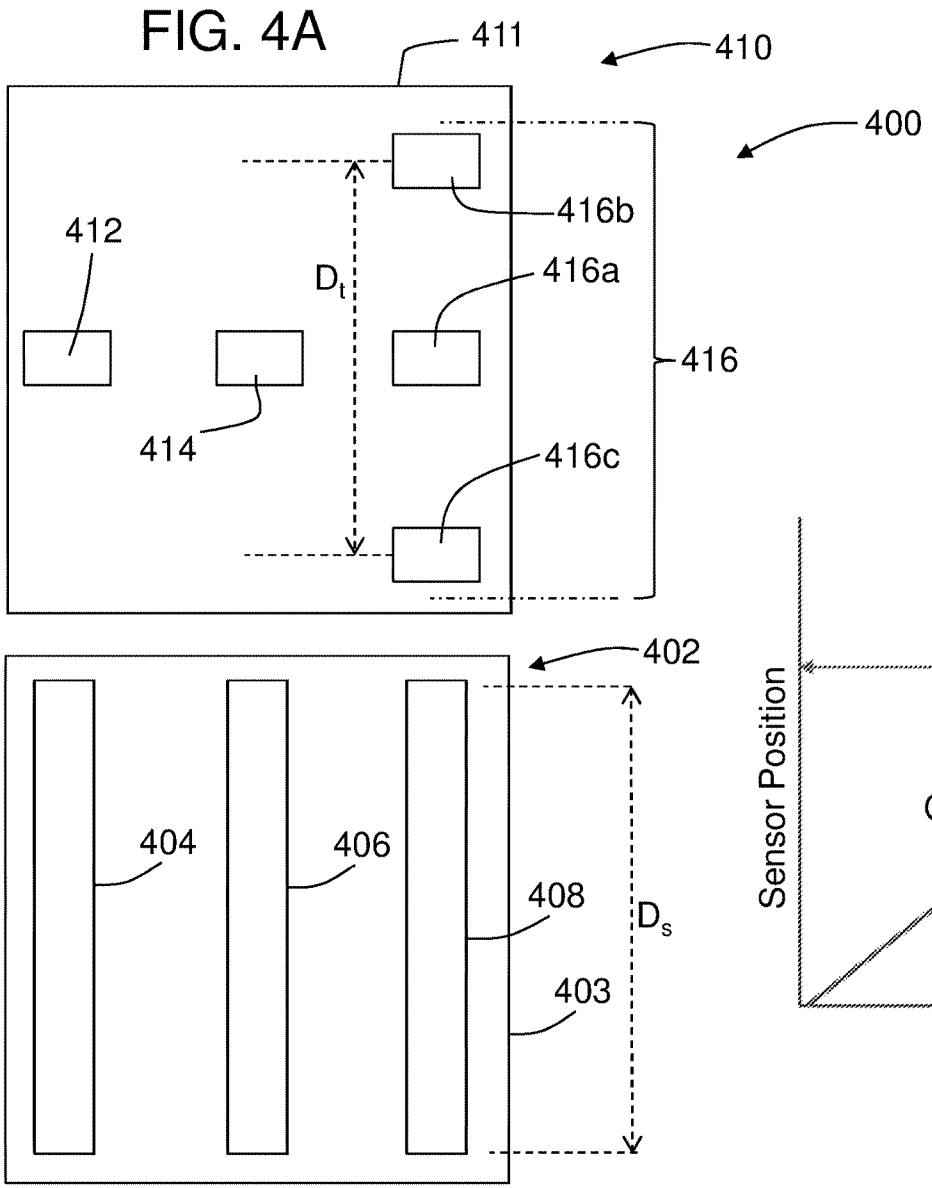
FIG. 4A is a schematic illustration of an elevator positioning system in accordance with embodiments of the present disclosure.
Figure 4B:
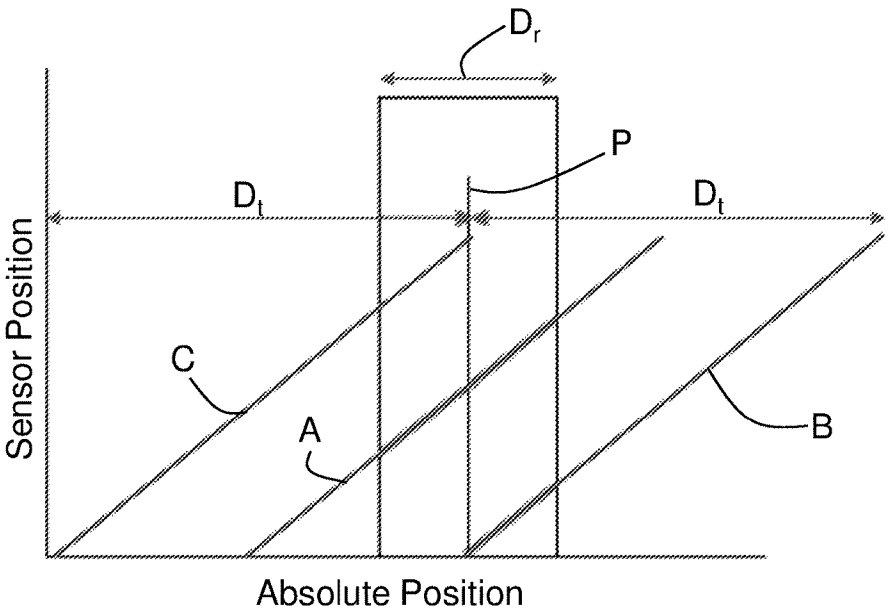
FIG. 4B is a plot illustration illustrating relative positions as detected using the elevator positioning system of FIG. 4A.

Referring now to FIGS. 4A-4B, a non-limiting embodiment of the present disclosure including an elevator positioning system 400 in the form of contactless linear inductive position sensors is shown. The elevator positioning system 400 can be employed to provide direct, high-resolution measurement of a motion state (e.g., position and/or velocity) of an elevator car relative to a landing. For example, as shown in FIG. 4A, an elevator car 402 includes a first sensor assembly 403 having a plurality of sensors. As shown, the first sensor assembly 403 includes a first sensor 404, a second sensor 406, and an optional third sensor 408. Each sensor 404, 406, 408 can include one or more sensing elements or sensing components. Although shown in a specific example configuration, those of skill in the art will appreciate that an elevator car can be equipped with any number sensor assemblies, sensors, and/or sensing elements as part of the sensor assemblies.

To determine the position of the elevator car 402 relative to a landing 410, the landing 410 (and each landing in an elevator shaft) is configured with a second sensor assembly 411. For example, as shown in FIG. 4A, the second sensor assembly 411 is arranged as a tag assembly, with the tags being sensors and/or sensor elements. As shown, the second sensor assembly 411 includes a first tag 412, a second tag 414, and a third tag 416 having a first tag element 416*a*, a second tag element 416*b*, and a third tag element 416*c*. The position of the second sensor assembly 411 (and tags 412, 414, 416) is installed such that when the elevator car 402 is aligned with the landing 410, each of the sensors 404, 406, 408 of the first sensor assembly 403 are positioned proximate to each of the tags 412, 414, 416 of the second sensor assembly 411. As shown, the tag elements 416*a*, 416*b*, 416*c* of the third tag 416 are spaced across a span of a tag spacing distance $D_t$ and the sensors 404, 406, 408 span an operational distance $D_s$. In some non-limiting embodiments, the tag spacing distance $D_t$ and the sensor operational distance $D_s$ are approximately equal.

In one non-limiting example, an individual sensing element (404*a*, 406*a*, 408*a*, 408*b*, 408*c*) of the first sensor assembly 403 consists of a set of coils which inductively couples to a respective tag element (412*a*, 414*a*, 416*a*, 416*b*, 416*c*) of the second sensor assembly 411. Variations in the position of the tag elements relative to respective sensing elements corresponds to a variation in inductance, i.e., the distance between a tag element and a sensing element is correlated to an inductance. An assembly of these sensors and tags provides various benefits for position detection. For example, the elevator positioning system 400 can provide for redundancy in regions where high reliability is needed to determine elevator car position (e.g., to safely open the doors at a landing) and an extended stroke of the sensor assembly beyond the length of just a single sensor and tag.

In operation, to detect a position, the sensed position from each of the sensors 404, 406, 408 in the assembly is combined to calculate: (i) a true position of the car relative to the landing and (ii) safety signals permitting the doors to open while the car is in operation (e.g., in the releveling region). Optional tag(s) 416*a* can be included with encoded information to uniquely identify each floor (via frequency encoding).

FIG. 4B illustrates a plot of relative positions, with the vertical axis represents sensing element position and the horizontal axis representing absolute position within an elevator shaft. On the plot, a landing position P is indicated for a position when the elevator car 402 is aligned with the landing 410. Further, relative positions of sensing elements A, B, C (corresponding to alphanumeric element labels of FIG. 4A, e.g., third tag 416 having first tag element 416*a*, second tag element 416*b*, and third tag element 416*c*). Further, as illustrated, a releveling region $D_r$ is shown within which feedback from the elevator positioning system 400 is provided to a computing system and/or controller of an elevator system for the purposes of leveling (e.g., as shown in FIGS. 1-2).

As shown, the lines A, B, C represent the relative positions reported for the various sensing elements that are positioned around the landing position P. As the elevator car 402 is moved away from the landing position P the third sensor 408 will transition to either tag element 416*b* or 416*c*. For example, if the elevator car 402 is moved upward relative to the landing 410, only the second tag element 416*b* will be detectable by the third sensor 408 corresponding to line B. If the elevator car 402 is moved downward relative to the landing 410, only third tag element 416*c* will be detectable to the third sensor 408 corresponding to line C. In this way, a continuous measurement of a motion state of an elevator car can be obtained beyond the stroke of a single sensor/tag combination.

As compared to various other types of position sensing detection, the approach described above and shown in FIGS. 4A-4B offers a number of benefits. For example, the assembly described above can provide direct car motion state/landing position feedback to be provided for elevator car positioning control and/or obtaining information related to elevator position within an elevator shaft. Further, depending on the sensor/tag configuration, embodiments can provide an ability to uniquely identify each floor which can eliminate need for correction runs (i.e., run to the terminal of the elevator shaft in order to identify absolute position). Additionally, advantageously, the calculated positions of the landing can be electronically adjusted for fine tuning after installation. Although described with respect to a specific example of an elevator positioning system 400, those of skill in the art will appreciate that various types and configurations of sensors/sensing elements can be employed without departing from the scope of the present disclosure.

Figure 5B:
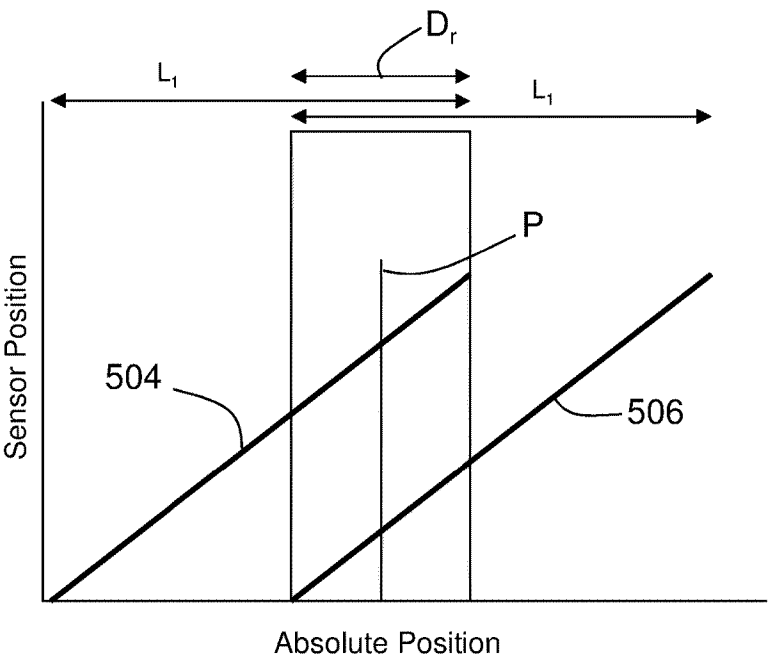
FIG. 5B is a plot illustration illustrating relative positions as detected using the elevator positioning system of FIG. 5A.
Figure 5A:
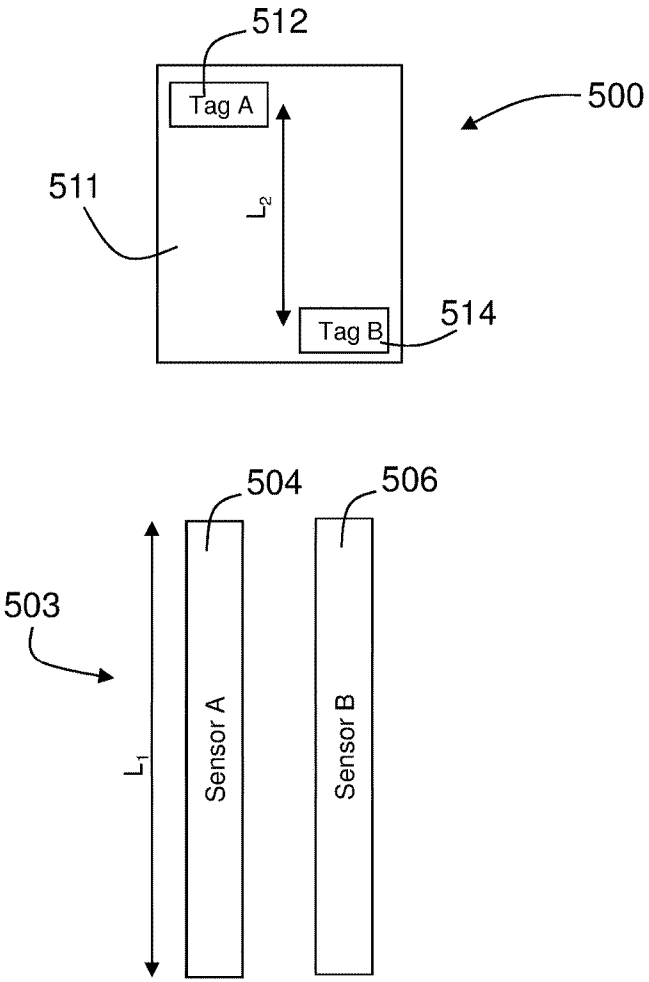
FIG. 5A is a schematic illustration of an elevator positioning system in accordance with embodiments of the present disclosure.

Turning now to FIGS. 5A-5B, an elevator positioning system 500 in accordance with an embodiment of the present disclosure is shown. The elevator positioning system 500 includes a first sensor assembly 503 and a second sensor assembly 511, with the first sensor assembly 503 mounted to an elevator car and the second sensor assembly 511 fixed relative to a landing within an elevator shaft. In this embodiment, the first sensor assembly 503 includes a first sensor 504 and a second sensor 506 and the second sensor assembly 511 includes a first tag 512 and a second tag 514. As shown, the first sensor 504 aligns with the first tag 512 and the second sensor 506 aligns with the second tag 514. As such, as an elevator car moves vertically with respect to the second sensor assembly 511 (e.g., at a landing) the first sensor 504 will move along and relative to the first tag 512 and the second sensor 506 will move along and relative to the second tag 514.

The arrangement of FIG. 5A can provide cross-checking between the first and second sensors 504, 506 for safety critical functions. Such a system is relatively simple and easy to configure, yet can provide critical information to an elevator system equipped with such elevator positioning system 500. As shown, the sensors 504, 506 of the first sensor assembly 503 each have a first sensor length $L_1$. Further, the tags 512, 514 of the second sensor assembly 511 are separated by a second sensor length $L_2$. In some embodiments, the second sensor length $L_2$ is less than the first sensor length $L_1$, and in some embodiments, the second sensor length $L_2$ may be about half the first sensor length $L_1$.

FIG. 5B illustrates a similar position plot as that shown in FIG. 4B. That is, the horizontal axis is absolute position and the vertical axis represents sensing element positions. As shown, a signal of the first sensor 504 and a signal of the second sensor 506 are shown relative to a releveling region $D_r$ (which may be similar in length as the second sensor length $L_2$) which is a range about a landing position P. By using the two sensors 504, 506, an accurate position of an elevator car at a landing can be measured.

Figure 6B:
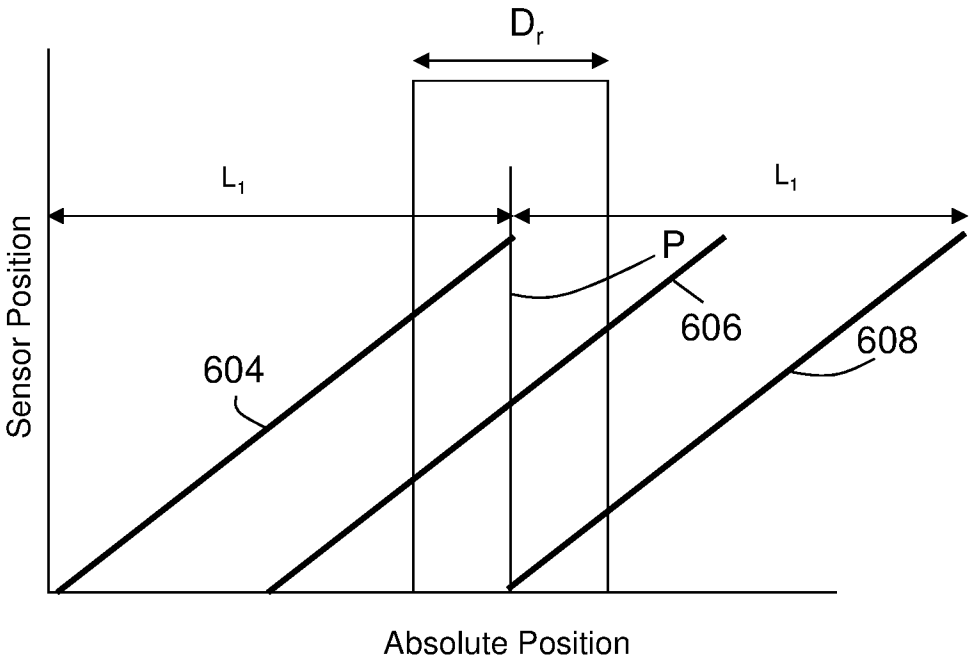
FIG. 6B is a plot illustration illustrating relative positions as detected using the elevator positioning system of FIG. 6A.
Figure 6A:
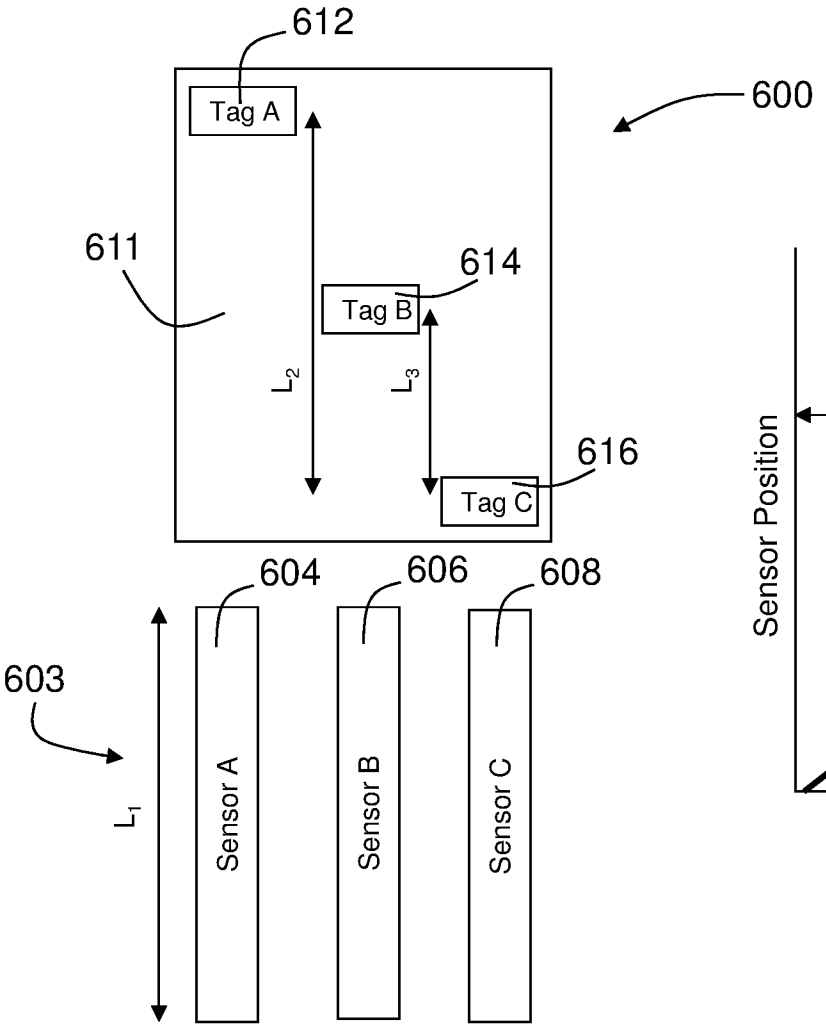
FIG. 6A is a schematic illustration of an elevator positioning system in accordance with embodiments of the present disclosure.

Turning now to FIGS. 6A-6B, an elevator positioning system 600 in accordance with an embodiment of the present disclosure is shown. The elevator positioning system 600 includes a first sensor assembly 603 and a second sensor assembly 611. The first sensor assembly 603 is mounted to an elevator car and the second sensor assembly 611 is fixed relative to a landing within an elevator shaft. In this embodiment, the first sensor assembly 603 includes a first sensor 604, a second sensor 606, and a third sensor 608. The second sensor assembly 611 includes a first tag 612, a second tag 614, and a third tag 616. As shown, the first sensor 604 aligns with the first tag 612, the second sensor 606 aligns with the second tag 614, and the third sensor 608 aligns with the third tag 616. As such, as an elevator car moves vertically with respect to the second sensor assembly 611 (e.g., at a landing) the first sensor 604 will move along and relative to the first tag 612, the second sensor 606 will move along and relative to the second tag 614, and the third sensor 608 will move along and relative to the third tag 616.

The arrangement of FIG. 6A can provide cross-checking between the first and second sensors 504, 506 for safety critical functions and can provide for adjustable tag locations, provide extended monitoring and/or position sensing, etc. As shown, the sensors 604, 606, 608 of the first sensor assembly 603 each have a first sensor length $L_1$. Further, as shown, the first tag 612 and the third tag 616 are separated by a second sensor length $L_2$ and the second tag 614 is separated from the third 616 by a third sensor length $L_3$. In some embodiments, the second sensor length $L_2$ is approximately equal to the first sensor length $L_1$, and the third sensor length $L_3$ is less than the first and/or the second sensor lengths $L_1$, $L_2$. In some embodiments, the third sensor length $L_3$ may be about half of the first sensor length $L_1$.

FIG. 6B illustrates a similar position plot as that shown in FIG. 4B. That is, the horizontal axis is absolute position and the vertical axis represents sensing element positions. As shown, a signal of the first sensor 604, a signal of the second sensor 606, and a signal of the third sensor 608 are shown relative to a releveling region $D_r$ which is a range about a landing position P. By using the three sensors 604, 606, 608 an accurate position of an elevator car at a landing can be measured.

Figure 7:
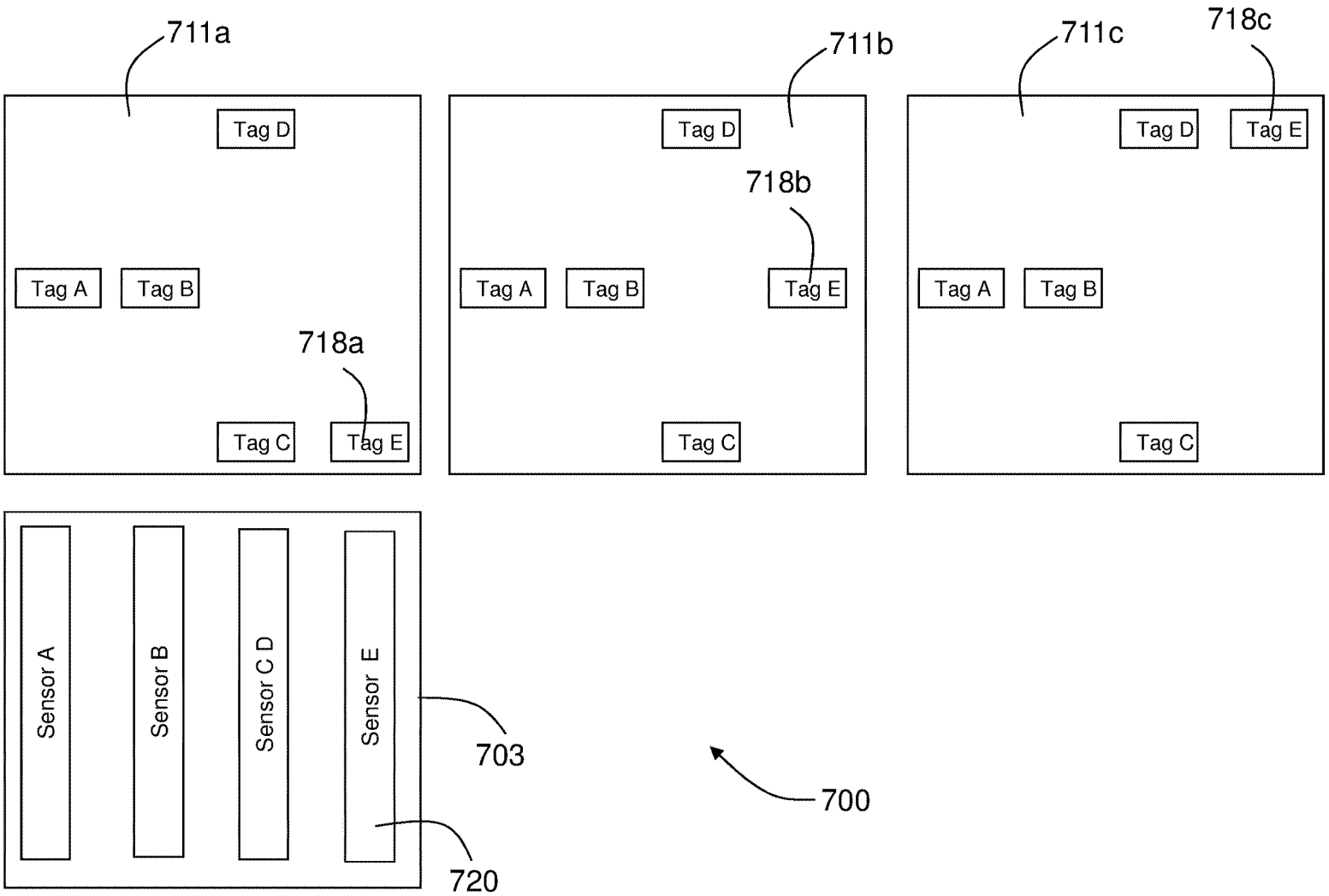
FIG. 7 is a schematic illustration of an elevator positioning system in accordance with embodiments of the present disclosure.

Turning now to FIG. 7, a schematic illustration of an elevator positioning system 700 in accordance with an embodiment of the present disclosure is shown. In this embodiment, a first sensor assembly 703 is configured on an elevator car and a plurality of second sensor assemblies 711*a*, 711*b*, 711*c* are shown. The second sensor assemblies 711*a*, 711*b*, 711*c* are each located at a respective landing within an elevator shaft and thus can provide position information when an elevator car having the first sensor assembly 703 is located proximate thereto. The arrangement of the tags on the second sensor assemblies 711*a*, 711*b*, 711*c* is similar to that shown and described with respect to FIGS. 4A-4B. However, in this embodiment, each of the second sensor assemblies 711*a*, 711*b*, 711*c* includes a respective landing identification tag 718*a*, 718*b*, 718*c*. The first sensor assembly 703 includes a landing identification sensor 720 that aligns with the landing identification tags 718*a*, 718*b*, 718*c* such that when the first sensor assembly 703 is in proximity to a landing identification tag 718*a*, 718*b*, 718*c*, an elevator controller or other computing system can readily identify where the elevator car is located.

Figure 8:
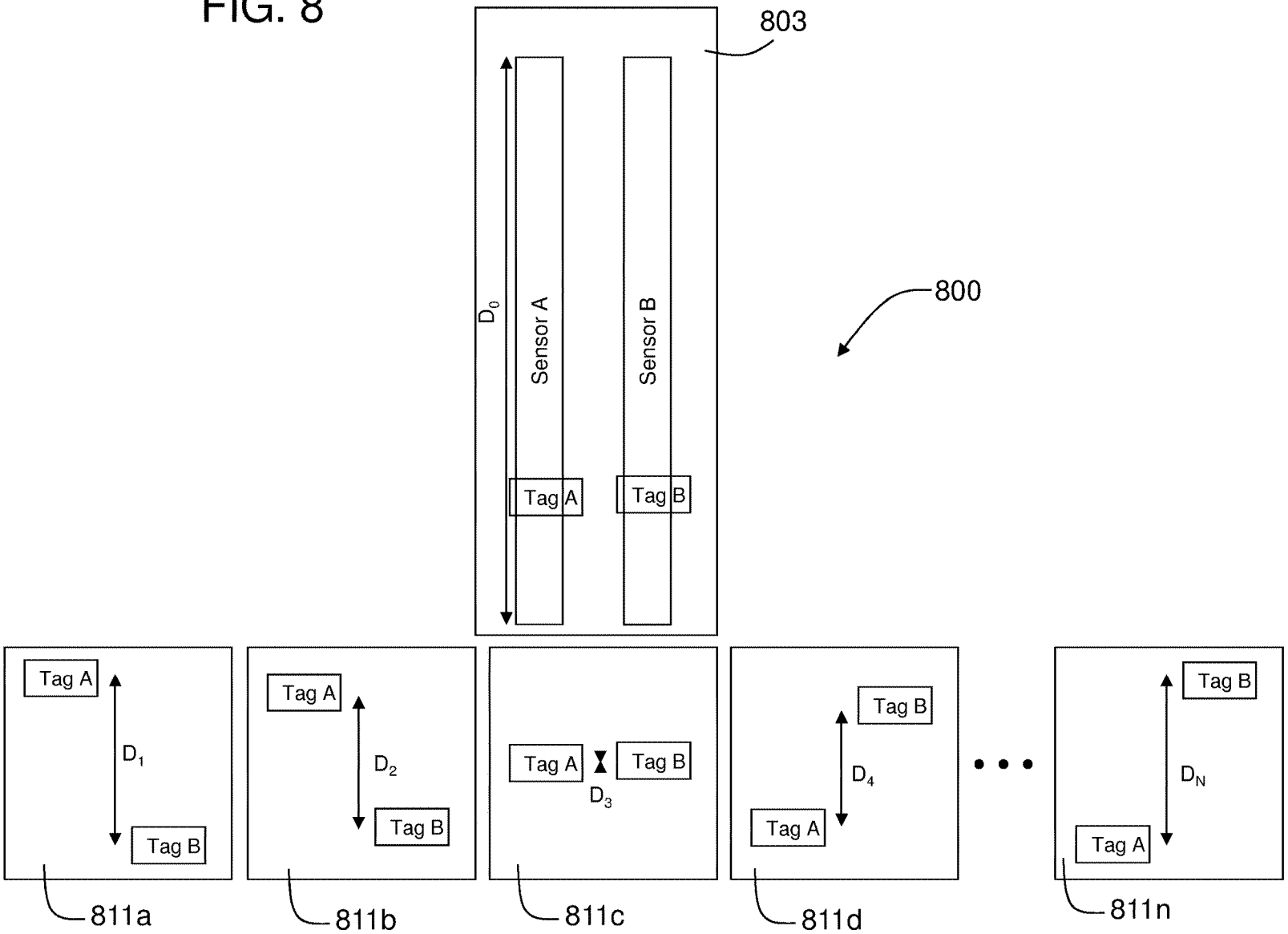
FIG. 8 is a schematic illustration of an elevator positioning system in accordance with embodiments of the present disclosure.

Turning now to FIG. 8, a schematic illustration of an elevator positioning system 800 in accordance with an embodiment of the present disclosure is shown. In this embodiment, a first sensor assembly 803 is configured on an elevator car and a plurality of second sensor assemblies 811*a*, 811*b*, 811*c*, 811*d*, 811*n* are shown. The second sensor assemblies 811*a*, 811*b*, 811*c*, 811*d*, 811*n* are each located at a respective landing within an elevator shaft having n landings. The first sensor assembly 803 can provide position information when an elevator car having the first sensor assembly 803 is located proximate to any of the second sensor assemblies 811*a*, 811*b*, 811*c*, 811*d*, 811*n*. In the embodiment of FIG. 8, the second sensor assemblies 811*a*, 811*b*, 811*c*, 811*d*, 811*n* are arranged to enable floor identification by a different means than that described above.

The second sensor assemblies 811*a*, 811*b*, 811*c*, 811*d*, 811*n* include two tag elements positioned relative to each other on the respective second sensor assembly 811*a*, 811*b*, 811*c*, 811*d*, 811*n*. A respective landing is identified by a detected separation between the two tags of the second sensor assemblies 811*a*, 811*b*, 811*c*, 811*d*, 811*n*. As shown, the sensors of the first sensor assembly 803 have a sensor length $D_0$. A first landing second sensor assembly 811*a* includes a first tag and a second tag separated by a first tag separation distance $D_1$, wherein the first tag separation distance $D_1$ is less than the sensor length $D_0$. A second landing second sensor assembly 811*b* includes a first tag and a second tag separated by a second tag separation distance $D_2$, wherein the second tag separation distance $D_2$ is less than the first tag separation distance $D_1$. A third landing second sensor assembly 811*c* includes a first tag and a second tag separated by a third tag separation distance $D_3$, wherein the third tag separation distance $D_3$ is less than the second tag separation distance $D_2$. Similar tag separation distances $D_4$ . . . $D_N$ are arranged with respect to each landing n within the elevator system. Such changes in tag separation distance from one tag to the next can be used to identify the specific landing at which the elevator car (and the first sensor assembly 803) is located. As shown, the relative distances between the first tag and the second of each second sensor assembly can be determined as positive (e.g., $D_1$, $D_2$), zero (e.g., $D_3$), or negative (e.g., $D_4$, $D_N$). For example, with n landings (and thus n second sensor assemblies), the first tag separation distance $D_1$ being a maximum, positive tag separation distance, f being a current landing, and d being the current tag separation distance of a given second sensor assembly of landing f, the current landing can be determined by $d=2D_1*(f/n)-D$; or $r=2D_1/n$.

Figure 9:
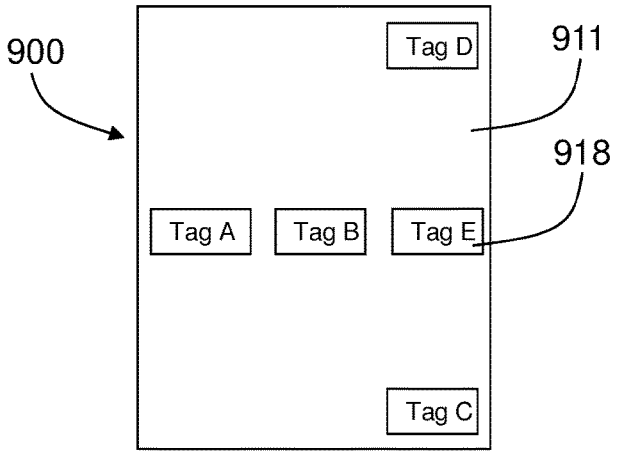
FIG. 9 is a schematic illustration of a second sensor assembly of an elevator positioning system in accordance with embodiments of the present disclosure.

Turning now to FIG. 9, a schematic illustration of a second sensor assembly 911 of an elevator positioning system 900 in accordance with an embodiment of the present disclosure is shown. In this embodiment, the second sensor assembly 911 includes a plurality of tag elements similar to that shown and described above. However, in this embodiment, one of the tags is a landing identification tag 918. The landing identification tag 918 can be arranged with a specific frequency or other characteristic that is selected to enable identification of the landing at which the second sensor assembly 911 is located. In some embodiments, in combination with a frequency or alternatively thereto, the landing identification tag 918 can be positioned relative to the other tag elements on the second sensor assembly 911 (e.g., similar to landing identification tags 718*a*, 718*b*, 718*c* shown in FIG. 7), which can then be used to identify a landing.

Figure 10:
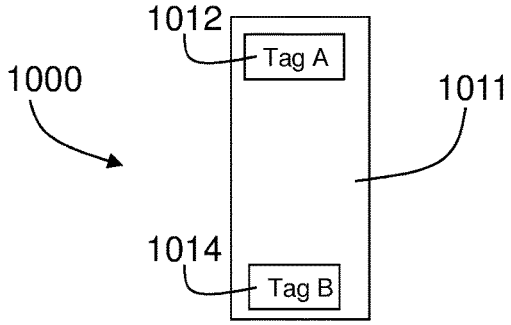
FIG. 10 is a schematic illustration of a second sensor assembly of an elevator positioning system in accordance with embodiments of the present disclosure.

Turning now to FIG. 10, a schematic illustration of a second sensor assembly 1011 of an elevator positioning system 1000 in accordance with an embodiment of the present disclosure is shown. In this embodiment, the second sensor assembly 1011 includes a first tag 1012 and a second tag 1014 arranged in a compact manner. In this embodiment the first tag 1012 is configured with a first frequency and the second tag 1014 is configured with a second frequency. Using multiple tags at different frequencies enables overlapping of detection by a single first sensor assembly located on an elevator car. Further, such compact arrangements may enable less occupied space or required space for the elevator positioning system 1000. In some embodiments, different numbers of tags can be installed on the compact second sensor assembly. For example, in some embodiments, a landing identification tag can be arranged thereon. Further, in some embodiments, the relative positions of the tags on the second sensor assembly can be used to enable landing identification.

Embodiments provided herein can be used for landing positioning, landing identification, landing position adjustment, elevator car location identification, etc. In some non-limiting embodiments, the sensor assemblies described herein (one or both of the first and second sensor assemblies) are arranged in communication with a computing system and/or elevator controller. Using such systems, the landing position at each landing can be defined in software and detected measurements can be compared against known/stored data. If the detected measurements do not match the known data, the position of the elevator car can be adjusted to align such measured data and the known information. Accordingly, accurate elevator car position relative to a landing can be achieved. In one non-limiting example, software parameters can include landing positions. Thus, at installation, the elevator car can be properly aligned or calibrated to the various landings of the elevator shaft. If any adjustments must be made at the time of installation, the parameters can be adjusted easily using the computing system. Further, after installation is complete, any offsets can be measure and then adjusted using the same computing system.

Figure 11:
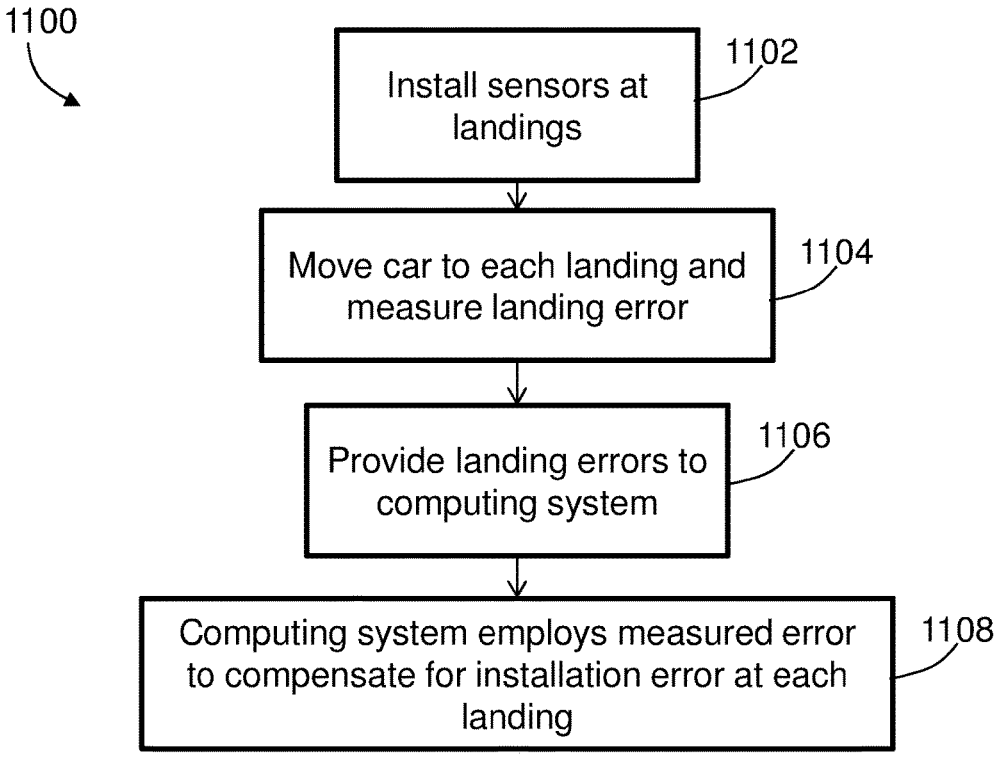
FIG. 11 is a landing position adjustment flow process in accordance with an embodiment of the present disclosure.

Turning to FIG. 11, a landing position adjustment flow process 1100 in accordance with an embodiment of the present disclosure is shown. The landing position adjustment flow process 1100 can employ sensor assemblies as described herein.

At block 1102, each landing within an elevator system is installed with a second sensor assembly, with a first sensor assembly installed to an elevator car within an elevator shaft. The first and second sensor assemblies are configured to interact with each other such that the first sensor assembly can detect the second sensor assembly when the two sensor assemblies are in proximity to each other. At block 1104, the elevator car is moved to each landing within the elevator shaft and a landing error is measured. At block 1106, the measured landing errors are conveyed to a computing system or other processor. At block 1108, the computing system uses the measured landing errors to compensate for installation errors at each landing. Thus, the landing position for each landing can be accurately set.

In some embodiments, the flow process can incorporate a calibration or learning associated with unique floor identifiers. For example, in some embodiments, as described above, different tag combinations or codes can be used to uniquely identify each of the floors or landings within an elevator shaft. During the flow process 1100, a computing system can learn the specific tag combinations or codes and assign identification to each and thus ensure accurate position information within an elevator shaft. In one non-limiting example of such learning, during installation of the elevator system, the elevator can be moved from the lowest landing to the highest landing. As the elevator car moves through the elevator shaft, the order of the tags (and the unique codes or signals associated therewith) can be used to identify which tags are associated with which floors the tags are installed at.

Although shown and described with a single sensor assembly located on and elevator car and a single sensor assembly located at each landing, the present disclosure is not limited thereto. For example, multiple first sensor assemblies and/or multiple second sensor assemblies may be installed on the elevator car or the landings, respectively. In some embodiments, the second sensor assemblies can be located at positions between landings to aid in accurate elevator car position within the elevator shaft. Further, sensor assemblies can be installed on sills, rails, door operators, door panels, guards, toe guards, fascia, or other elements/components of an elevator system. Further, in some embodiments, the sensor assemblies may be mounted using dedicated framing or brackets, rather than being mounted or fixed to existing components of the elevator system. Thus the embodiments shown and described herein are not to be limiting, but are rather provided for illustrative and explanatory purposes.

Advantageously, embodiments provided herein are directed to sensor assembly arrangements that provide for contactless sensing of an elevator position within an elevator car. Such sensor assembly arrangements can enable unique identifying of each landing within an elevator system. Further, sensor assembly arrangements of the present disclosure can provide absolute position of the elevator car within the elevator shaft, and thus potential elimination of correction runs after installation or on a regular maintenance schedule. Further, embodiments provided herein can direct car/landing position feedback for improved control performance, including hovering/re-leveling operations, as will be appreciated by those of skill in the art. Furthermore, position of the landing can be electronically adjusted for after installation, thus reducing the need to adjust components in the elevator shaft after installation is completed. Moreover, embodiments provided herein can provide improved sensing of actual landing accuracy for system health monitoring.

As described herein, in some embodiments various functions or acts may take place at a given location and/or in connection with the operation of one or more apparatuses, systems, or devices. For example, in some embodiments, a portion of a given function or act may be performed at a first device or location, and the remainder of the function or act may be performed at one or more additional devices or locations.

Embodiments may be implemented using one or more technologies. In some embodiments, an apparatus or system may include one or more processors and memory storing instructions that, when executed by the one or more processors, cause the apparatus or system to perform one or more methodological acts as described herein. Various mechanical components known to those of skill in the art may be used in some embodiments. For example, various different types of motion state sensors can be employed without departing from the scope of the present disclosure.

Embodiments may be implemented as one or more apparatuses, systems, and/or methods. In some embodiments, instructions may be stored on one or more computer program products or computer-readable media, such as a transitory and/or non-transitory computer-readable medium. The instructions, when executed, may cause an entity (e.g., an apparatus or system) to perform one or more methodological acts as described herein.

Aspects of the disclosure have been described in terms of illustrative embodiments thereof. Numerous other embodiments, modifications and variations within the scope and spirit of the appended claims will occur to persons of ordinary skill in the art from a review of this disclosure. For example, one of ordinary skill in the art will appreciate that the steps described in conjunction with the illustrative figures may be performed in other than the recited order, and that one or more steps illustrated may be optional.

What is claimed is:

1. An elevator system comprising:

an elevator machine operably connected to an elevator car located within an elevator shaft, the elevator shaft including a plurality of landings;

at least one first sensor assembly attached to the elevator car comprising a first sensor, a second sensor, and a third sensor;

a plurality of second sensor assemblies arranged within the elevator shaft and configured to interact with the at least one first sensor assembly, wherein each landing of the plurality of landings includes an associated second sensor assembly from the plurality of second sensor assemblies; and a computing system operably connected to and in communication with at least one of (i) the at least one first sensor assembly and (ii) the plurality of second sensor assemblies such that the computing system receives at least one of signals or data from the operably connected assembly or assemblies when the at least one first sensor assembly interacts with a second sensor assembly of the plurality of second sensor assemblies, wherein the at least one first sensor assembly and the plurality of second sensor assemblies form a contactless position sensing system for determining a position of the elevator car within the elevator shaft, wherein each of the plurality of second sensor assemblies comprises a plurality of tags, wherein a first tag is arranged to align with the first sensor, a second tag is arranged to align with the second sensor, and a third tag is arranged to align with the third sensor and the third tag comprises a first tag element and a second tag element separated by a tag spacing distance and a third tag element, the third tag element having a predetermined frequency selected to enable identification of a respective associated landing of the plurality of landings by the contactless position sensing system, wherein the predetermined frequency of the third tag comprises encoded information to uniquely identify each landing, and wherein the computing system is configured to:

determine a landing error for each landing to compensate for installation errors to determine a set landing position for each landing based on an interaction of the first, second, and third sensors with the respective first, second, and third tags at each landing;

identify, during elevator operation, a specific landing based on a detected third tag of a second sensor assembly, and control the elevator machine to adjust, during the elevator operation, a landing position of the elevator car to the set landing position at the specific landing based on an interaction of the first, second, and third sensors with the respective first, second, and third tags at each landing.

2. The system of claim 1, wherein the at least one first sensor assembly comprises a transmit coil and two receive coils.

3. The system of claim 2, wherein the two receive coils comprise a sine coil and a cosine coil.

4. The system of claim 1, wherein each tag of each second sensor assembly comprises a passive cooperating tag.

5. The system of claim 1, wherein a unique position offset among the plurality of tags of each second sensor assembly within the elevator shaft is measurable to determine a landing within the elevator shaft.

6. The system of claim 1, wherein the sensors of the at least one first sensor assembly and the tags of the second sensor assemblies define overlapping detection regions at each respective landing.

7. The system of claim 1, wherein the at least one first sensor assembly is mounted to a toe guard of the elevator car.

8. The system of claim 1, further comprising an elevator controller, wherein the computing system is in communication with the elevator controller, the elevator controller arranged to control operation of the elevator car within the elevator shaft.

9. The system of claim 8, wherein the computing system is an integral component of the elevator controller.

10. The system of claim 8, wherein at least one of the computing system and the elevator controller are arranged to detect a location of the elevator car within the elevator shaft based on a detection of a third tag of at least one of the plurality of second sensor assemblies in at least one of a unique position and unique frequency configuration.

11. The system of claim 8, wherein at least one of the computing system and the elevator controller control a position of the elevator car based on the determined position of the elevator car.

12. The system of claim 8, wherein at least one of the computing system and the elevator controller control a leveling operation of the elevator car relative to a landing based on the determined position of the elevator car.

13. A method for installing an elevator car within an elevator shaft having a plurality of landings, the method comprising:

installing at least one first sensor assembly on the elevator car comprising a first sensor, a second sensor, and a third sensor;

installing a plurality of second sensor assemblies within the elevator shaft, wherein at least one second sensor assembly is installed at each landing of the plurality of landings, wherein each second sensor assembly comprises a plurality of tags, wherein a first tag is arranged to align with the first sensor, a second tag is arranged to align with the second sensor, and a third tag is arranged to align with the third sensor and the third tag comprises a first tag element and a second tag element separated by a tag spacing distance and a third tag element, the third tag element having a predetermined frequency selected to enable identification of a respective associated landing, and wherein the at least one first sensor assembly and the plurality of second sensor assemblies form a contactless position sensing system for determining a position of the elevator car within the elevator shaft, wherein the predetermined frequency of the third tag comprises encoded information to uniquely identify each landing;

moving the elevator car to each landing of the plurality of landings and identifying which second sensor assembly of the plurality of second sensor assemblies is associated with each landing;

measuring a landing error at each landing based on an interaction of the first, second, and third sensors with the respective first, second, and third tags at each landing;

providing the landing error for each landing to a computing system;

using the landing error for each landing to compensate for installation errors to determine a set landing position for each landing;

identifying, during elevator operation, a specific landing based on a detected third tag of a second sensor assembly, and adjusting, during elevator operation, with an elevator machine, a landing position of the elevator car to the set landing position at the specific landing.

14. The method of claim 13, wherein the at least one first sensor assembly comprises transmit and receive coils and each second sensor assembly comprises passive cooperating tags.

15. The method of claim 13, further comprising identifying the specific landing based on a unique position offset among multiple tags in a given second sensor assembly.

* * * * *